US010918256B2

(12) United States Patent
Romaya

(10) Patent No.: US 10,918,256 B2
(45) Date of Patent: Feb. 16, 2021

(54) CLEANING TOWEL SYSTEM

(71) Applicant: Marcella Romaya, Temecula, CA (US)

(72) Inventor: Marcella Romaya, Temecula, CA (US)

( * ) Notice: Subject to any disclaimer, the term of this patent is extended or adjusted under 35 U.S.C. 154(b) by 26 days.

(21) Appl. No.: 16/293,451

(22) Filed: Mar. 5, 2019

(65) Prior Publication Data

US 2019/0269282 A1 Sep. 5, 2019

Related U.S. Application Data

(60) Provisional application No. 62/638,763, filed on Mar. 5, 2018.

(51) Int. Cl.

| | |
|---|---|
| ***A47K 10/02*** | (2006.01) |
| ***A47K 10/12*** | (2006.01) |
| ***A47L 13/16*** | (2006.01) |
| *A47L 15/00* | (2006.01) |

(52) U.S. Cl.

CPC ..... *A47L 13/16* (2013.01); *A47K 10/02* (2013.01); *A47K 10/12* (2013.01); *A47L 15/0068* (2013.01)

(58) Field of Classification Search

CPC ..... A63B 57/60; A47L 13/16; A47L 25/00; A47L 17/00; A47L 15/0068; A47L 15/0065; A47K 10/02; A47K 10/12

See application file for complete search history.

(56) References Cited

U.S. PATENT DOCUMENTS

| | | | | |
|---|---|---|---|---|
| 1,785,512 | A * | 12/1930 | Buttenheim | A47L 23/10 15/210.1 |
| 2,060,012 | A * | 11/1936 | Baker | A47L 13/252 15/229.7 |
| 2,420,344 | A * | 5/1947 | Alexander | A47G 9/064 2/69 |
| 5,813,080 | A * | 9/1998 | Hendren | A63B 57/60 15/118 |
| 6,186,155 | B1 * | 2/2001 | Cheek | A47K 10/02 134/6 |
| 9,010,705 | B2 * | 4/2015 | Dastrup | A63B 57/60 248/225.21 |
| 10,653,288 | B2 * | 5/2020 | Batchelor, Jr. | A47L 13/38 |

* cited by examiner

*Primary Examiner* — Laura C Guidotti

(57) ABSTRACT

The cleaning towel includes one or more fabrics, joined together to form a sleeve along a top portion of the towel. The sleeve is configured to receive a bendable member. An opening opens into the sleeve to facilitate insertion and removal of the bendable member into and from the sleeve. By joining multiple edges together, a cavity may be formed within the towel, adjacent to the sleeve. An opening may be provided along one or more edges for accessing the cavity. The fabric(s) may be of the same or differing materials. The towel may be of varying sizes and constructed of a variety of suitable materials. Likewise, the bendable member may be constructed in varying sizes and made of a variety of suitable materials, depending on the particular application and desired flexibility. The towel may include a hang loop to facilitate engagement with a hang hook.

19 Claims, 10 Drawing Sheets

CLEANING TOWEL SYSTEM

CROSS-REFERENCE TO RELATED APPLICATION(S)

The present application claims priority to US Provisional Utility Patent Application No. 62/638,763 filed on Mar. 5, 2018, entitled "BENDABLE TOWEL", the entire disclosure of which is incorporated by reference herein.

BACKGROUND OF THE INVENTION

Field of Invention

This invention relates to multi-purpose cleaning towels.

Description of Related Art

Traditionally, a towel consists of a piece of fabric used for cleaning or drying a surface. Towels come in a variety of shapes and sizes, and are manufactured from various textiles, depending on the intended use. Generally, towels are constructed as a flat, two-sided sheet. There are also various cleaning mitts that are designed to be worn on a user's hand, whereby one or both sides of the mitt can be used for cleaning and are constructed of the same material. Cleaning surfaces of cleaning mitts are generally constructed of a microfiber material that is advantageous for dusting, washing cars, personal hygienic cleansing, etc.

While towels and cleaning mitts are useful in cleaning and/or drying a majority of surfaces, they are incapable, or highly ineffective, at cleaning and/or drying some surfaces that are difficult for a user's hand to access. For example, the interior surfaces of wine glasses, champagne flutes, reusable water bottles, and other vessels are largely inaccessible by an adult human hand. Accessing these hard-to-reach areas is generally accomplished using a cleaning wand or by cramming a towel into the area, whereby a small portion of the towel is used to manipulate the inserted portion for cleaning and/or drying. Due to the unstructured, i.e., flaccid, quality of a towel, this cramming method is oftentimes ineffective at fully drying hard-to-reach areas, vessels, etc., leaving water streaks and/or water spots.

Based on the foregoing, there is a need in the art for a multi-purpose cleaning towel that has multiple cleaning surfaces, whereby the cleaning surfaces may be constructed of the same material or different materials for various applications. Further, there is a need in the art for a towel that includes a means of imparting structure and formability to the towel.

SUMMARY OF THE INVENTION

The present disclosure provides a cleaning towel system, along with example methods of manufacture and use therefor. The system includes a towel having a sleeve configured to receive a bendable member. In an example, the bendable member is constructed of a material that is flexible, compressible, and resilient, e.g., foam. One or more cleaning surfaces extend from a bottom of the sleeve. The towel may be constructed of a single fabric or multiple fabrics joined together. As such, the cleaning surfaces may be made of the same fabric, or some or all of the cleaning surfaces may be made of different fabrics, depending on the desired application. The towel may further include a hang loop and, optionally, a hang hook to facilitate storage of the towel when not in use.

In an embodiment, the cleaning surfaces are joined to one another along a single edge, allowing them to be lifted or manipulated independently of one another. In a further embodiment, one or more corresponding outer edges of the cleaning surfaces are joined together to form a cavity between the cleaning surfaces. The cavity may be accessible through an opening at an exterior of the cleaning surfaces, e.g., along edges of the cleaning surfaces that are not joined together. The cavity opening allows a user to access the interior of the cavity, e.g., to insert his/her hand into the cavity to use the towel as a mitt for cleaning, drying, polishing, etc.

In an embodiment, at least one opening opens into the sleeve, allowing the bendable member to be inserted into and removed from the sleeve. For example, an opening may be provided at one or both ends of the sleeve and/or at a side and/or the top of the sleeve. Alternatively, or additionally, an opening may extend through a seam at the bottom of the sleeve. In such a configuration, the opening provides open communication between the sleeve and an area between the cleaning surfaces. Therefore, the bendable member can be inserted into and removed from the sleeve from between cleaning surfaces.

In an embodiment, additional cleaning surfaces may be joined to a rear surface of each cleaning surface. In a further embodiment, non-permeable membranes may be disposed between the joined cleaning surfaces to prevent transfer of liquid and debris between the respective cleaning surfaces.

In an embodiment, the towel is constructed of a double-sided material, whereby one cleaning surface is permanently bonded to a rear surface of another cleaning surface. The cleaning surfaces may be constructed of the same or different materials.

The foregoing and other features and advantages of the invention will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF PREFERRED EMBODIMENTS

Figure 1:
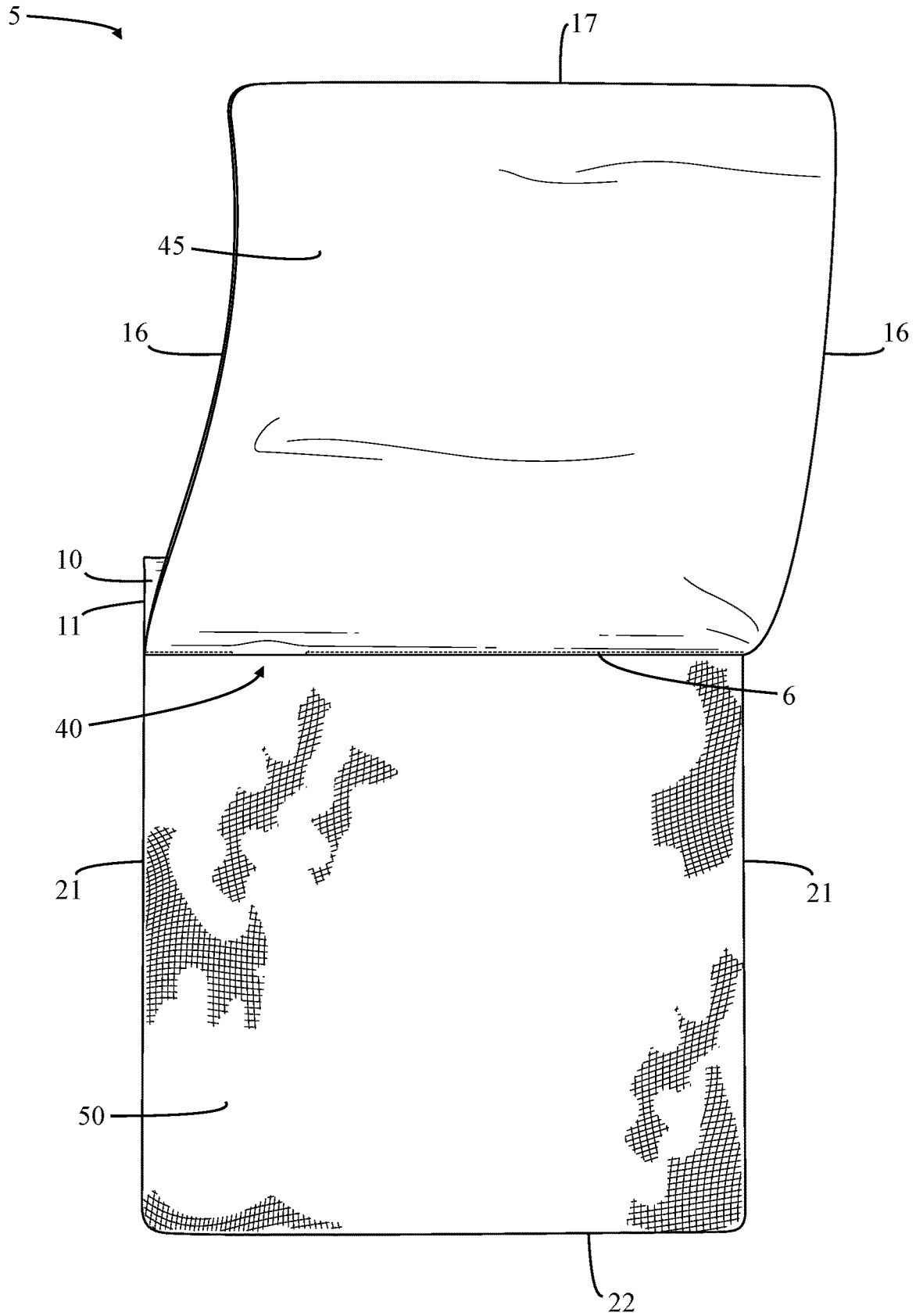
FIG. 1 shows a perspective view of the cleaning towel system with a cleaning surface lifted, according to an embodiment of the present invention.
Figure 2:
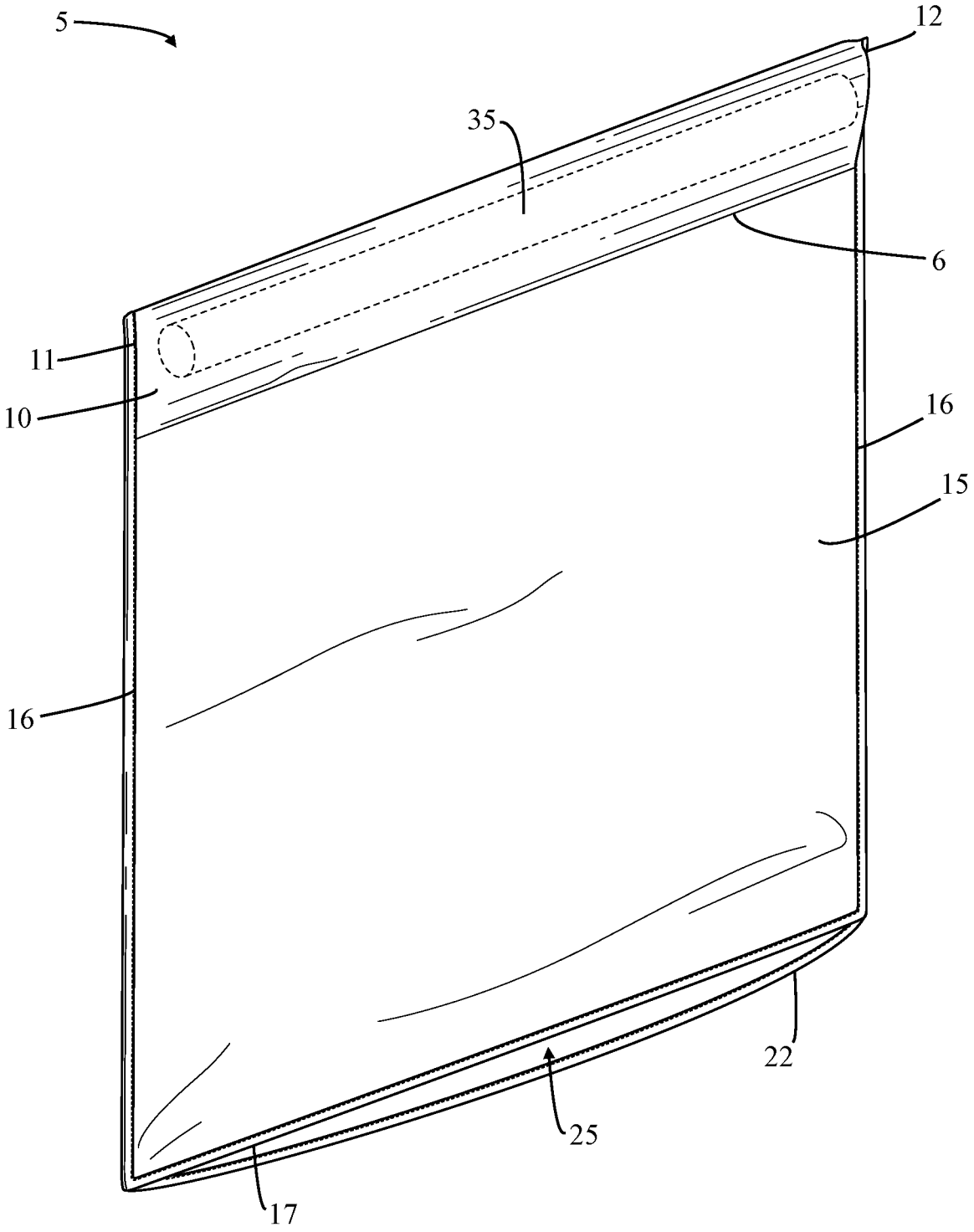
FIG. 2 shows a front perspective view of the cleaning towel system, according to an embodiment of the present invention.
Figure 3:
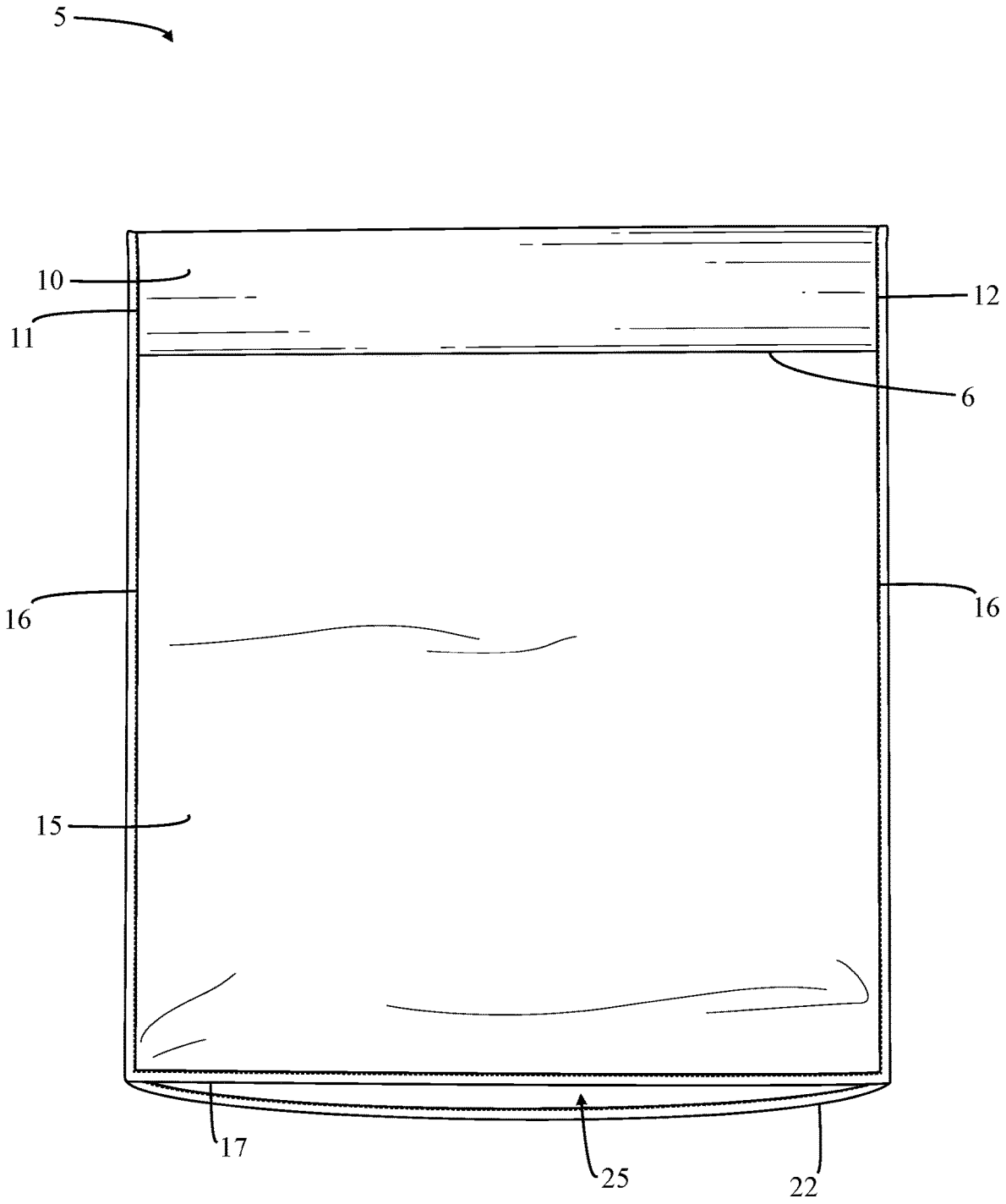
FIG. 3 shows a front elevational view of the cleaning towel system, according to an embodiment of the present invention.

Preferred embodiments of the present invention and their advantages may be understood by referring to FIGS. 1-10, wherein like reference numerals refer to like elements.

Figure 6:
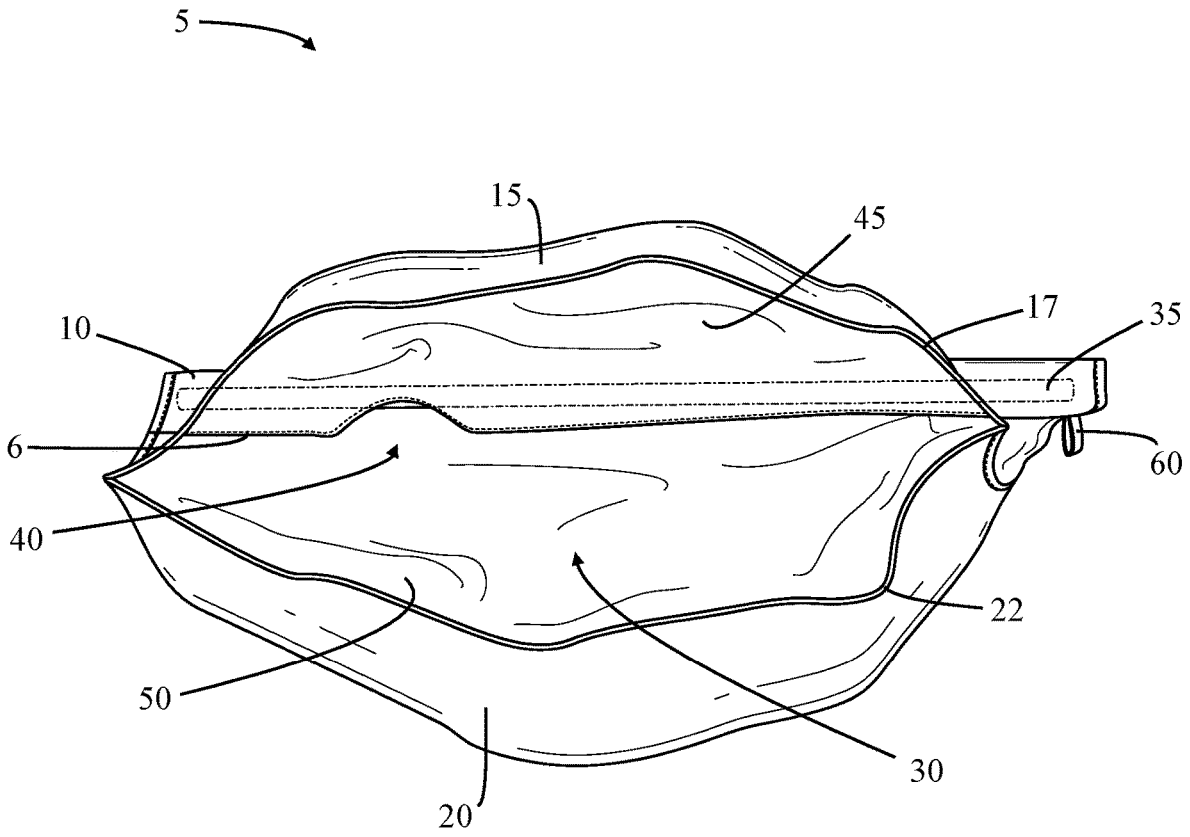
FIG. 6 shows a bottom perspective view of the cleaning towel system, looking into the cavity, according to an embodiment of the present invention.
Figure 7:
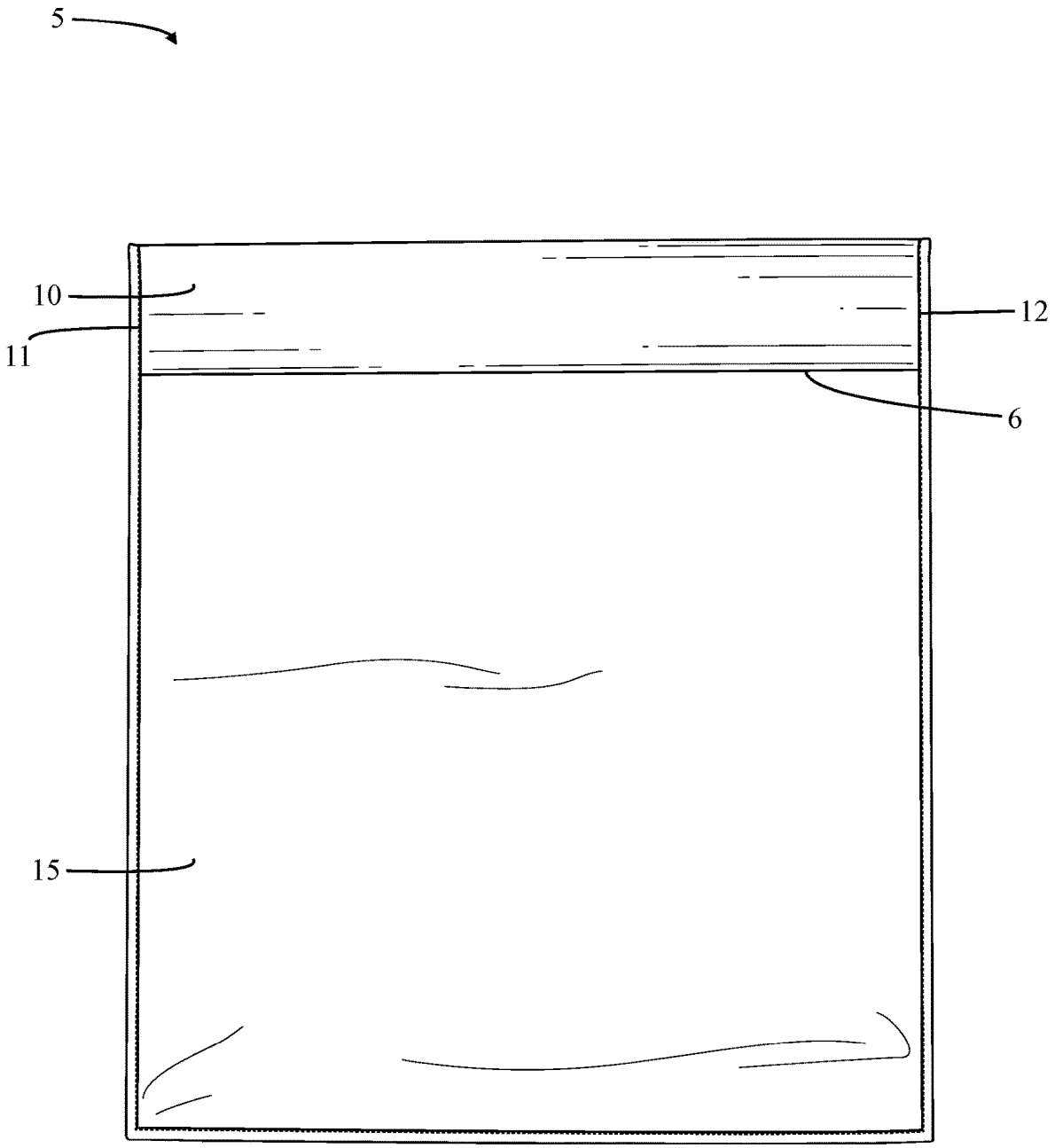
FIG. 7 shows a front elevational view of the cleaning towel system, according to an embodiment of the present invention.
Figure 8:
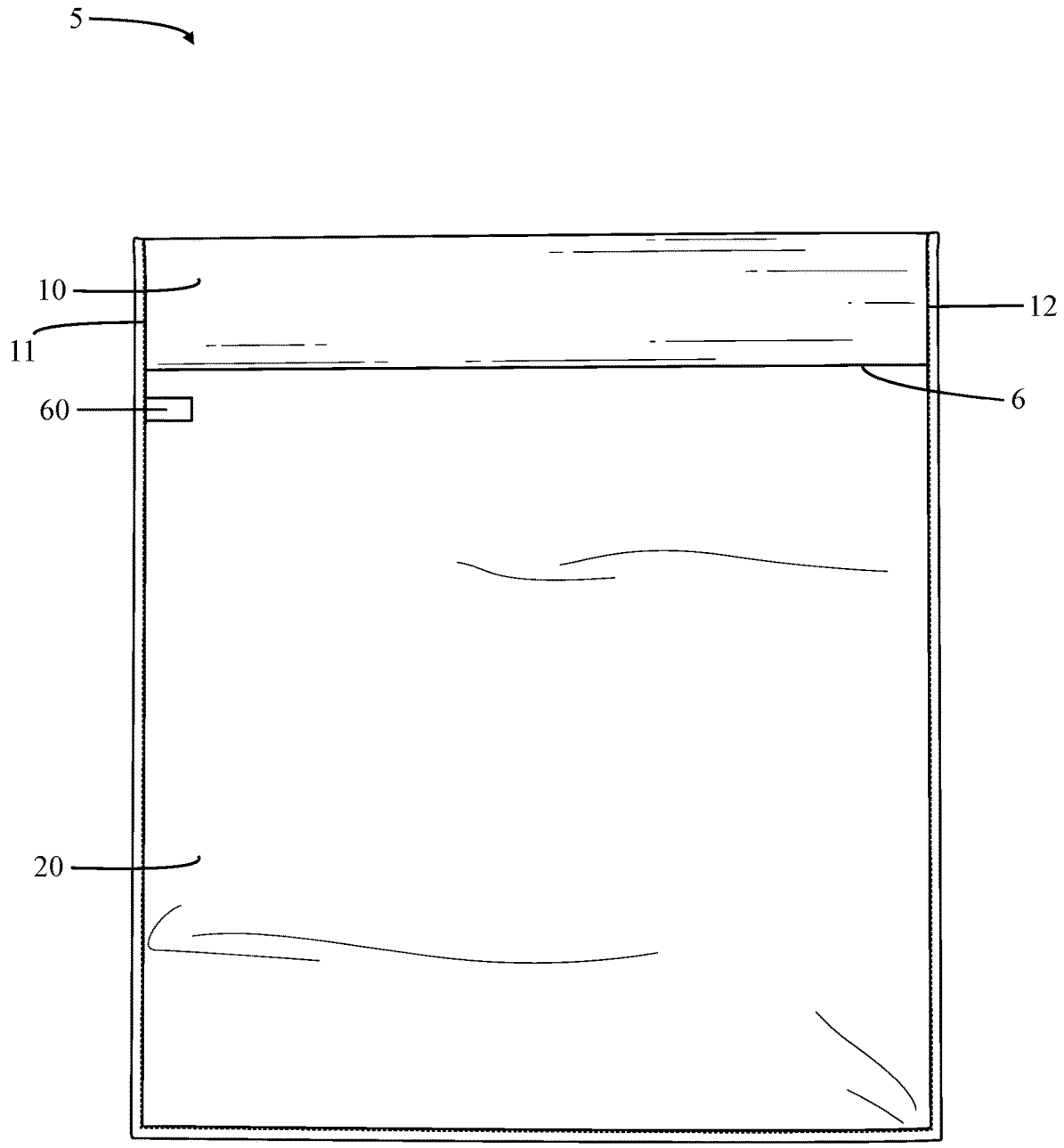
FIG. 8 shows a rear elevational view of the cleaning towel system, according to an embodiment of the present invention.
Figure 9:
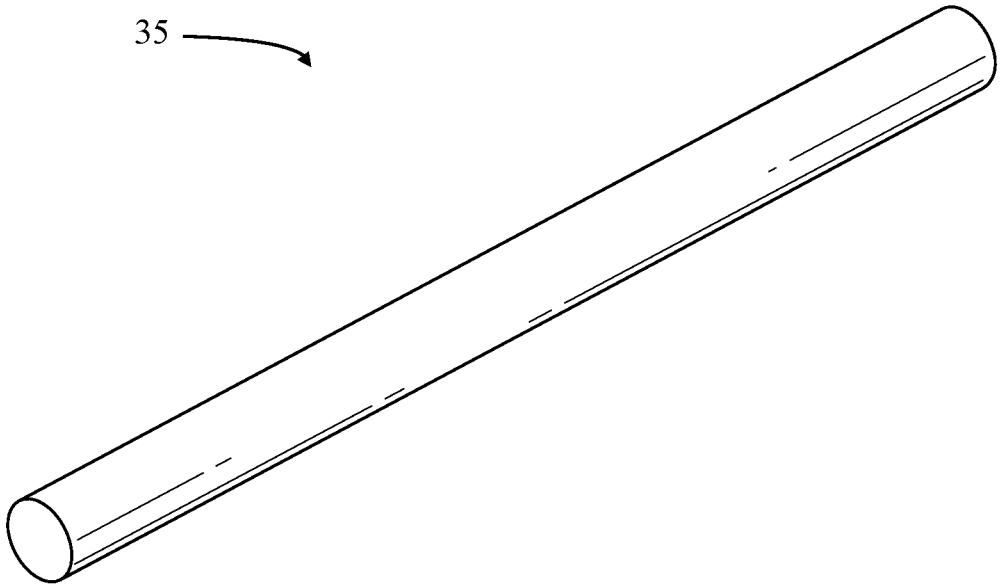
FIG. 9 shows a perspective view of the bendable member of the cleaning towel system, according to an embodiment of the present invention.
Figure 10:
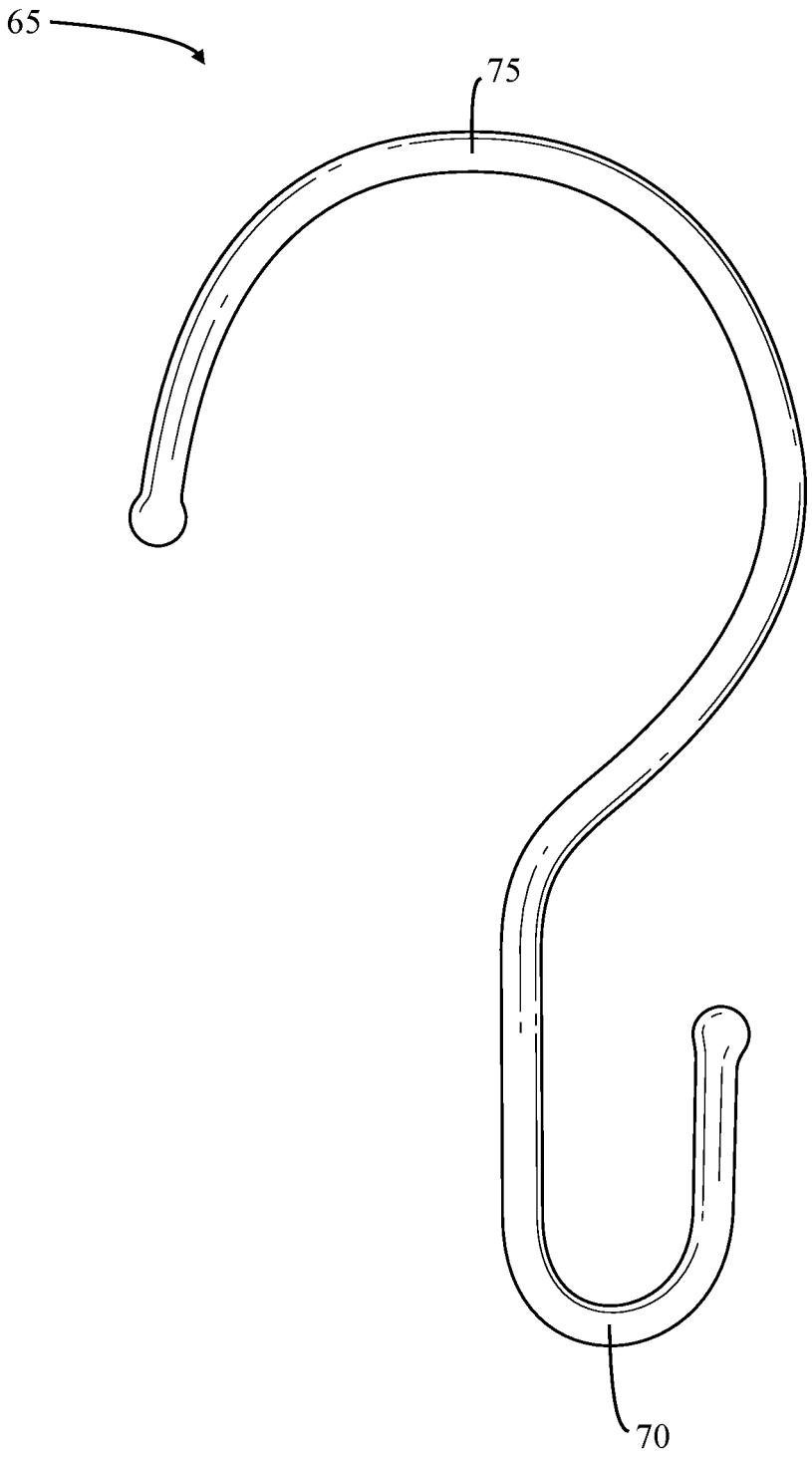
FIG. 10 shows a side elevational view of the hang hook of the cleaning towel system, according to an embodiment of the present invention.

With reference to FIGS. 1-9, cleaning towel 5 is constructed of one or more fabrics joined at seam 6 to form a sleeve 10 with cleaning surfaces 15, 20 extending therefrom. In an embodiment, as shown in FIG. 1, cleaning surfaces 15, 20 are joined along a single edge, i.e., at seam 6, allowing them to be lifted independently of one another. In a further embodiment, as shown in FIGS. 2-6, side edges 16, 21 of cleaning surfaces 15, 20 are joined to one another, thereby forming opening 25 between lower edges 17, 22 of cleaning surfaces 15, 20. Opening 25 provides access to cavity 30 between cleaning surfaces 15, 20. In a further embodiment, lower edges 17, 22 are joined to close opening 25. Interior of sleeve 10 is dimensioned to accommodate bendable member 35. Further, sleeve 10 preferably includes at least one opening 40 to facilitate insertion and removal of bendable member 35. In another embodiment, as shown in FIGS. 7-8, cleaning towel 5 may be constructed, such that it includes only a singular cleaning surface 15. In a further embodiment, a double-sided material may be used to construct cleaning towel 5, whereby cleaning surfaces 15, 20 are bonded together without any space therebetween.

In an embodiment, cleaning towel 5 further includes internally-disposed cleaning surfaces 45, 50 joined to the rear of cleaning surfaces 15, 20, respectively, and disposed within cavity 30.

In yet a further embodiment, a non-permeable membrane (not shown) is disposed between cleaning surface 15 and cleaning surface 45, and, likewise, between cleaning surface 20 and cleaning surface 50. The non-permeable membrane prevents transfer of liquid and debris between the respective cleaning surfaces.

Depending on the intended application, cleaning surfaces 15, 20 may be constructed of the same or a different material, e.g., polyester, polyamide, microfiber, or cotton. For example, it may be desirable to use the same absorbent material for cleaning surfaces 15, 20. Alternatively, it may be desirable, e.g., when drying wine glasses or champagne flutes, to use a polishing cloth for cleaning surface 15 and an absorbent material for cleaning surface 20. Likewise, cleaning surfaces 45, 50, when employed, may be constructed of the same or a different material than the remaining cleaning surfaces 15, 20, 45, 50.

Figure 4:
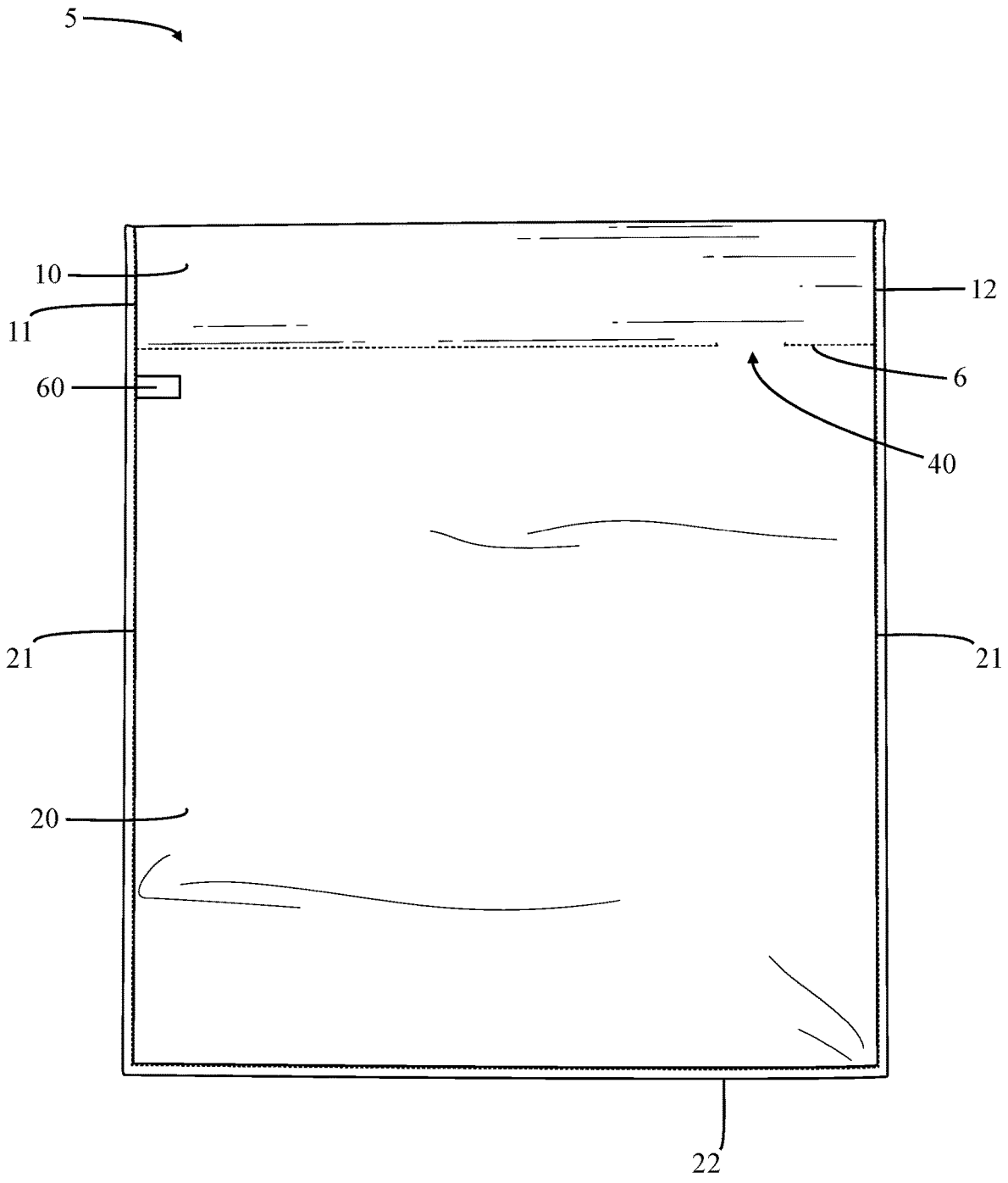
FIG. 4 shows a rear elevational view of the cleaning towel system, according to an embodiment of the present invention.
Figure 5:
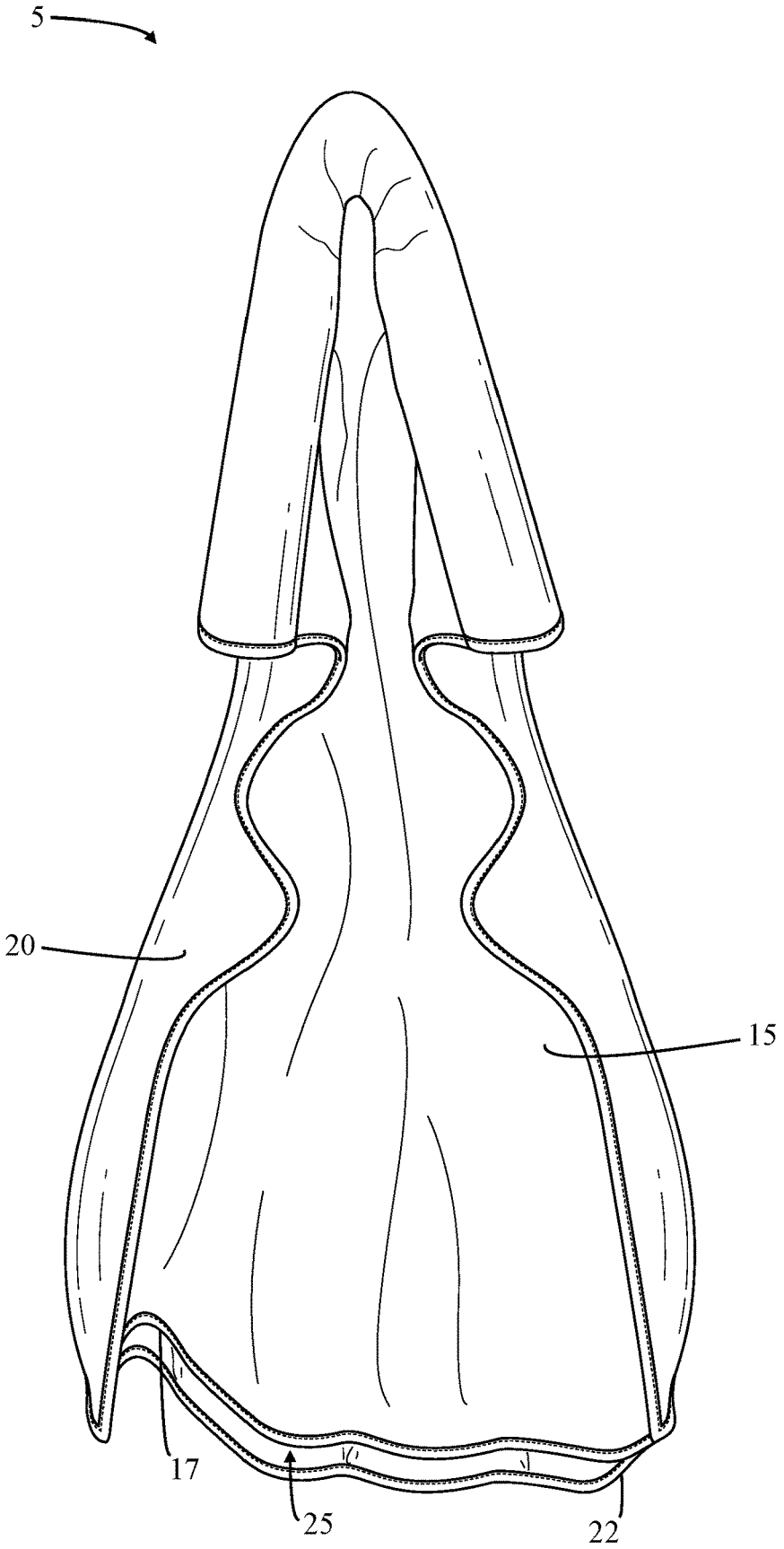
FIG. 5 shows a front perspective view of the cleaning towel system, according to an embodiment of the present invention.

In a preferred embodiment, as shown in FIGS. 1, 4, and 6, sleeve opening 40 is formed by a gap in the joinder of the one or more fabrics at seam 6. With reference to FIG. 1, sleeve opening 40 is accessed by lifting one of cleaning surfaces 15, 20. With reference to FIGS. 4 and 6, sleeve opening 40 is accessed from within cavity 30 and provides open communication between cavity 30 and sleeve 10. Placement of sleeve opening 40 through seam 6 alleviates potential contact of bendable member, and/or closure means (not shown) that may be employed for closing sleeve opening 40, with items being cleaned, dried, polished, etc. While placement of sleeve opening 40 through seam 6 is preferred, alternative placement of sleeve opening 40 may be employed. For example, sleeve opening 40 may be disposed at one or both sleeve ends 11, 12, or on a front, rear or top surface of sleeve 10.

In a preferred embodiment, bendable member 35 is cylindrical and is constructed of a material that is flexible, compressible, and resilient, e.g., foam. Bendable member 35 should be able to flex or bend at any point along its length. Although flexible, the bendable member 35 should be able to impart structure and formability to cleaning towel 5 when in use.

In an embodiment, as shown on FIGS. 4, 6, and 8, hang loop 60 is disposed on exterior of cleaning towel 5. Hang loop 60 is configured to facilitate storage of cleaning towel 5, e.g., on a towel or robe hook, when not in use. In a further embodiment, with reference to FIG. 10, hang hook 65 provides a means for hanging cleaning towel 5 on items larger than a standard hook, e.g., door knobs. Hang hook 65 includes a small hook 70 and a large hook 75. Small hook 70 engages hang loop 60, and large hook 75 engages the item on which cleaning towel 5 is stored.

In a preferred embodiment, joinder of fabrics, e.g., along seam 6, along cleaning surfaces' side edges 16, 21, and/or along edges of sleeve ends 11, 12, is accomplished by stitching the fabrics together. Joinder of the fabric(s) by stitching is preferred over alternative joinder means, such as hook and loop fasteners, snaps, buttons, adhesives, etc. that may scratch, chip, or otherwise damage delicate items being cleaned, dried, and/or polished. However, depending on the application, alternative means of joining the fabrics, e.g., snaps, buttons, hook and loop fasteners, adhesives, etc., may be employed.

Methods of Manufacture

Following are sample methods of manufacturing cleaning towel 5. They are for illustration purposes only, and should not be regarded as limiting the scope of the invention disclosed and claimed.

A first method of manufacturing cleaning towel 5 begins with folding a singular piece of fabric in half and sewing seam 6 across a top portion of the folded fabric in parallel with the fold to form a division between sleeve 10 and cleaning surfaces 15, 20. Seam 6 is sewn with a gap therein, to form sleeve opening 40. Next, corresponding side edges of sleeve 10 are sewn together to close sleeve ends 11, 12.

Another method of manufacturing cleaning towel 5 begins with folding a singular piece of fabric in half and sewing seam 6 across a top portion of the folded fabric in parallel with the fold to form a division between sleeve 10 and cleaning surfaces 15, 20. Seam 6 is sewn with a gap therein, to form sleeve opening 40. Next, corresponding side edges of cleaning towel 5, i.e., cleaning surfaces' side edges 16, 21 and edges of sleeve ends 11, 12, are sewn together, closing sleeve ends 11, 12 and forming opening 25 between lower edges 17, 22 of cleaning surfaces 15, 20. If desired, lower edges 17, 22 may also be joined.

Another method of manufacturing cleaning towel 5 begins with folding a singular piece of fabric in half and sewing seam 6 across a top portion of the folded fabric in parallel with the fold to form a division between sleeve 10 and cleaning surfaces 15, 20. Next, corresponding side edges at one end of sleeve 10 are sewn together, and corresponding side edges 16, 21 of cleaning surfaces 15, 20 are sewn together, closing one end of sleeve 10 and forming opening 25 between lower edges 17, 22 of cleaning surfaces 15, 20. If desired, lower edges 17, 22 may also be joined.

Another method of manufacturing cleaning towel 5 begins with folding a first piece of fabric once, such that the longitudinal axis is folded onto itself, forming a rear folded portion and a front folded portion. The front folded portion should be shorter than the rear folded portion, measured from top to bottom. Next, a second piece of fabric is sewn to the front folded portion, whereby a combined length of the front folded portion and the second piece of fabric, as joined, is substantially the same as the length of the rear folded portion. Next, seam 6 is sewn adjacent to the joinder seam of the second piece of fabric and the front folded portion to join rear folded portion to the front folded portion and/or the second piece of fabric, forming a division between sleeve 10 and cleaning surfaces 15, 20. Seam 6 is sewn with a gap therein, to form sleeve opening 40. Next, corresponding side edges of sleeve 10 are sewn together to close sleeve ends 11, 12.

Another method of manufacturing cleaning towel 5 begins with folding a first piece of fabric once, such that the longitudinal axis is folded onto itself, forming a rear folded portion and a front folded portion. The front folded portion should be shorter than the rear folded portion, measured from top to bottom. Next, a second piece of fabric is sewn to the front folded portion, whereby a combined length of the front folded portion and the second piece of fabric, as joined, is substantially the same as the length of the rear folded portion. Next, seam 6 is sewn adjacent to the joinder seam of the second piece of fabric and the front folded portion to join rear folded portion to the front folded portion and/or the second piece of fabric, forming a division between sleeve 10 and cleaning surfaces 15, 20. Seam 6 is sewn with a gap therein, to form sleeve opening 40. Next, corresponding side edges of cleaning towel 5, i.e., side edges 16, 21 and side edges of sleeve ends 11, 12, are sewn together, closing sleeve ends 11, 12 and forming opening 25 between lower edges 17, 22 of cleaning surfaces 15, 20. If desired, lower edges 17, 22 may also be joined.

Another method of manufacturing cleaning towel 5 begins with folding a first piece of fabric once, such that the longitudinal axis is folded onto itself, forming a rear folded portion and a front folded portion. The front folded portion should be shorter than the rear folded portion, measured from top to bottom. Next, a second piece of fabric is sewn to the front folded portion, whereby a combined length of the front folded portion and the second piece of fabric, as joined, is substantially the same as the length of the rear folded portion. Next, seam 6 is sewn adjacent to the joinder seam of the second piece of fabric and the front folded portion to join rear folded portion to the front folded portion and/or the second piece of fabric, forming a division between sleeve 10 and cleaning surfaces 15, 20. Next, corresponding side edges at one end of sleeve 10 are sewn together, and corresponding side edges of cleaning surfaces 15, 20 are sewn together, closing one end of sleeve 10 and forming opening 25 between lower edges 17, 22 of cleaning surfaces 15, 20. If desired, lower edges 17, 22 may also be joined.

Another method of manufacturing cleaning towel 5 begins with folding a singular piece of fabric once, such that the longitudinal axis is folded onto itself, forming a rear folded portion and a front folded portion. The front folded portion should be shorter than the rear folded portion, measured from top to bottom. Next, seam 6 is employed to join the rear folded portion to the front folded portion, forming a division between sleeve 10 and cleaning surface 15. Next, corresponding side edges of sleeve 10 are sewn together to close sleeve ends 11, 12.

Another method of manufacturing cleaning towel 5 begins with folding a singular piece of double-sided fabric once, such that the longitudinal axis is folded onto itself, forming a rear folded portion and a front folded portion. The two sides of the fabric may be the same or different materials, wholly joined, e.g., using an adhesive, to bond the materials and eliminate any space therebetween. The front folded portion should be shorter than the rear folded portion, measured from top to bottom. Next, seam 6 is employed to join the rear folded portion to the front folded portion, forming a division between sleeve 10 and cleaning surfaces 15, 20. Next, corresponding side edges of sleeve 10 are sewn together to close sleeve ends 11, 12. While the aforementioned sample methods of manufacture recite stitching as the means of joinder of the fabric(s), e.g., along seam 6, along cleaning surfaces' side edges 16, 21, and/or along edges of sleeve ends 11, 12, alternative means of joining the fabric(s), e.g., snaps, buttons, hook and loop fasteners, adhesives, etc., may be employed.

Methods of Use

A method of using cleaning towel 5 begins with inserting bendable member 35 into sleeve 10 through sleeve opening 40. Once bendable member 35 is properly seated in sleeve 10, a user grips sleeve 10 and rolls it onto cleaning surfaces 15, 20 until the cleaning towel 5 reaches a desired diameter. The desired application, e.g., moisture absorption, polishing, etc., will dictate which way the sleeve is rolled. For example, if cleaning surface 15 is a moisture absorbing fabric and cleaning surface 20 is a polishing fabric, and the objective is to dry a vessel, sleeve 10 would be rolled onto cleaning surface 20, such that cleaning surface 15 is exposed on the exterior of the rolled cleaning towel 5. The opposite would apply if the objective is to polish the vessel.

If the vessel is deeper and/or narrower, e.g., a reusable water bottle or champagne flute, one end of the covered bendable member 35 is inserted into the vessel, whereby the opposite end protrudes from the vessel. The user grips the protruding covered end of the bendable member 35 and, using it as leverage, turns the rolled cleaning towel clockwise or counter-clockwise within the vessel. Once moisture absorption or polishing is complete, the user grips the protruding covered end of the bendable member 35 and removes cleaning towel 5 from the vessel. Once removed, cleaning towel 5 is unrolled, allowing the user to use cleaning surfaces 15, 20, e.g., by inserting his/her hand into cavity 30 and using cleaning towel 5 as a mitt, to absorb moisture from and/or polish the exterior of the vessel.

If the vessel is shallower and/or wider, e.g., a wine glass, the rolled cleaning towel 5 can be bent in half, whereby the bend is inserted into the vessel and released, allowing the covered ends of the bendable member 35 to protrude from the vessel. The resiliency of bendable member 35 allows it to automatically open, forcing the cleaning towel 5 against the vessel's interior surfaces. Once opened against the vessel walls, the user grips the covered ends of the bendable member 35 and, using them as leverage, turns the cleaning towel clockwise or counter-clockwise within the vessel. Once moisture absorption or polishing is complete, the user grips the covered ends of the bendable member 35 and removes cleaning towel 5 from the vessel. Once removed, cleaning towel 5 is unrolled, allowing the user to use cleaning surfaces 15, 20, e.g., by inserting his/her hand into cavity 30 and using cleaning towel 5 as a mitt, to absorb moisture from and/or polish the exterior of the vessel.

If included, cleaning surfaces 45, 50 may be used to provide additional or alternative cleaning capabilities. For example, if one or both of cleaning surfaces 15, 20 are too moist or soiled, cleaning surfaces 45, 50 can be accessed, e.g., by turning cleaning towel 5 inside-out, to allow uninterrupted cleaning, drying, and/or polishing.

Once cleaning is complete, hang loop 60 is used to hang cleaning towel 5 for drying and storage. If necessary, hang hook 65 can be interengaged with hang loop 60 to facilitate hanging cleaning towel 5 for drying and storage. Alternatively, if desired, bendable member 35 can be removed from sleeve 10 through sleeve opening 40 in preparation for washing cleaning towel 5.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

I claim:

1. A cleaning towel system comprising:

a. a towel including:

i. a sleeve disposed along an upper portion of the towel;

ii. a first cleaning surface;

iii. a second cleaning surface, wherein the first cleaning surface and the second cleaning surface extend from a bottom of the sleeve, wherein a rear surface of the first cleaning surface and a rear surface of the second cleaning surface face one another;

iv. a third cleaning surface joined to the rear of the first cleaning surface; and v. a fourth cleaning surface joined to the rear of the second cleaning surface, wherein at least one of the first cleaning surface, the second cleaning surface, the third cleaning surface, and the fourth cleaning surface is constructed of a different material than the remaining cleaning surfaces; and b. a bendable member removably disposed within the sleeve.

2. The system of claim 1, wherein the first cleaning surface and the second cleaning surface can be lifted or manipulated independently of one another.

3. The system of claim 1, wherein the towel further includes at least one sleeve opening that opens into the sleeve, the at least one sleeve opening being configured to receive the bendable member therethrough.

4. The system of claim 3, wherein the at least one sleeve opening includes an opening that extends through a seam disposed at the bottom of the sleeve, wherein the opening provides open communication between the sleeve and an area between the third cleaning surface and the fourth cleaning surface.

5. The system of claim 1, wherein the bendable member is constructed of foam.

6. The system of claim 1, wherein a fabric used to construct the first cleaning surface is different than a fabric used to construct the second cleaning surface.

7. The system of claim 1, wherein one or more edges of the first cleaning surface and the third cleaning surface are joined to one or more corresponding edges of the second cleaning surface and the fourth cleaning surface, wherein the system further comprises a cavity defined by the third cleaning surface and the fourth cleaning surface, as bounded by the one or more joined edges and a seam extending along the bottom of the sleeve.

8. The system of claim 7, wherein the towel further includes:

a. at least one sleeve opening that opens into the sleeve, the at least one sleeve opening being configured to receive the bendable member; and b. a cavity opening that opens into the cavity from an exterior of the towel.

9. The system of claim 8, wherein the at least one sleeve opening includes an opening that extends through the seam, wherein the opening provides open communication between the sleeve and the cavity.

10. The system of claim 1, wherein the towel further includes:

a. a first non-permeable membrane disposed between the first cleaning surface and the third cleaning surface; and b. a second non-permeable membrane disposed between the second cleaning surface and the fourth cleaning surface.

11. The system of claim 1, wherein the towel further includes a hang loop.

12. The system of claim 11, further comprising a hang hook that includes at least one hook configured to be received by the hang loop.

13. A cleaning towel system comprising:

a. a towel including:

i. a sleeve disposed along an upper portion of the towel;

ii. a first cleaning surface;

iii. a second cleaning surface, wherein the first cleaning surface and the second cleaning surface extend from a bottom of the sleeve, wherein a rear surface of the first cleaning surface and a rear surface of the second cleaning surface face one another;

iv. a third cleaning surface joined to the rear of the first cleaning surface;

v. a fourth cleaning surface joined to the rear of the second cleaning surface;

vi. a first non-permeable membrane disposed between the first cleaning surface and the third cleaning surface; and vii. a second non-permeable membrane disposed between the second cleaning surface and the fourth cleaning surface; and b. a bendable member removably disposed within the sleeve.

14. The system of claim 13, wherein one or more edges of the first cleaning surface and the third cleaning surface are joined to one or more corresponding edges of the second cleaning surface and the fourth cleaning surface, wherein the system further comprises a cavity defined by the third cleaning surface and the fourth cleaning surface, as bounded by the one or more joined edges and a seam extending along the bottom of the sleeve.

15. The system of claim 14, wherein the towel further includes:

a. at least one sleeve opening that opens into the sleeve, the at least one sleeve opening being configured to receive the bendable member; and b. a cavity opening that opens into the cavity from an exterior of the towel.

16. The system of claim 15, wherein the at least one sleeve opening includes an opening that extends through the seam, wherein the opening provides open communication between the sleeve and the cavity.

17. The system of claim 13, wherein the bendable member is constructed of foam.

18. A cleaning towel system comprising:

a. a towel including:

i. a sleeve disposed along an upper portion of the towel;

ii. a first cleaning surface;

iii. a second cleaning surface, wherein the first cleaning surface and the second cleaning surface extend from a bottom of the sleeve, wherein a rear surface of the first cleaning surface and a rear surface of the second cleaning surface face one another, wherein one or more edges of the first cleaning surface are joined to one or more corresponding edges of the second cleaning surface, wherein the towel further includes a cavity defined by the rear surface of the first cleaning surface and the rear surface of the second cleaning surface, as bounded by the one or more joined edges and a seam extending along the bottom of the sleeve;

iv. at least one sleeve opening that opens into the sleeve, the at least one sleeve opening being configured to receive the bendable member, wherein the at least one sleeve opening includes an opening that extends through the seam, wherein the opening provides open communication between the sleeve and the cavity; and v. a cavity opening that opens into the cavity from an exterior of the towel; and b. a bendable member removably disposed within the sleeve.

19. The system of claim 18, wherein the bendable member is constructed of foam.

* * * * *